US008608097B2

(12) United States Patent
Murphy et al.

(10) Patent No.: US 8,608,097 B2
(45) Date of Patent: Dec. 17, 2013

(54) SYSTEM AND METHOD FOR MONITORING OPERATIONAL CHARACTERISTICS OF PULVERIZERS

(75) Inventors: Robert F. Murphy, Wethersfield, CT (US); James P. Sutton, South Windsor, CT (US); Rebecca L. Tobiasz, Suffield, CT (US); Sin K. Poon, Simsbury, CT (US)

(73) Assignee: ALSTOM Technology Ltd, Baden (CH)

( * ) Notice: Subject to any disclaimer, the term of this patent is extended or adjusted under 35 U.S.C. 154(b) by 283 days.

(21) Appl. No.: 12/941,502

(22) Filed: Nov. 8, 2010

(65) Prior Publication Data

US 2012/0111978 A1 May 10, 2012

(51) Int. Cl.
*B02C 4/32* (2006.01)

(52) U.S. Cl.
USPC ..... 241/33; 241/37

(58) Field of Classification Search
USPC ..... 241/33–37
See application file for complete search history.

(56) References Cited

U.S. PATENT DOCUMENTS

| | | | |
|---|---|---|---|
| 4,903,901 | A | 2/1990 | Kim et al. |
| 5,048,761 | A | 9/1991 | Kim |
| 7,182,283 | B1 | 2/2007 | Santucci |
| 7,226,010 | B2 | 6/2007 | Zhang et al. |

OTHER PUBLICATIONS

Engineering Consulants Group—"Roll-Bowl COP" Website at: http://www.ecg-inc.com/products.aspx?Product=RBC.
International Search Report and Written Opinion for PCT/US2011/058252 mailed Jun. 3, 2013.

*Primary Examiner* — Faye Francis

(57) ABSTRACT

In a system for monitoring the operating condition of a pulverizer, a sensor interface module positioned on or proximal to the pulverizer. The sensor interface module is operable to receive information generated by one or more sensors mounted on the pulverizer. An operator control station is in communication with the sensor interface module and is operable to receive data from the sensor interface module relevant to the signals received from the sensors. The operator control station is also operable to generate operational information indicative of a functional characteristic of the pulverizer and to track the operational information to determine whether degradation of the functional characteristic is occurring.

7 Claims, 4 Drawing Sheets

SYSTEM AND METHOD FOR MONITORING OPERATIONAL CHARACTERISTICS OF PULVERIZERS

TECHNICAL FIELD

The present disclosure relates generally to the operation and maintenance of pulverizers, and is more specifically directed to a system and method whereby various operational aspects of one or more pulverizers can be monitored to predict and/or address detrimental functional characteristics of the pulverizers.

BACKGROUND

Coal is used as a fuel in many power plants. Before the coal is introduced into the power plant it typically undergoes a pulverization process to reduce the size of the coal from relatively coarse chunks to a fine powder. This is done to increase the reactivity of the coal by increasing the effective surface area, to reduce surface moisture on the coal, and to make transportation of the coal into the furnace forming part of the power plant easier.

The coal is transformed into the above-described fine powder by a pulverizer. There are different types of pulverizers, for example, there are Ball-Type pulverizers, Roll-Bowl or Ball Race Pulverizers, Impact or Hammer Pulverizer Mills, and Attrition Type Pulverizers. Pulverization is the first process in the chain of power generation and is generally time consuming. The pulverizer is employed to dry and crush the correct amount of coal according to the amount of power to be generated. If the pulverizer's operation is compromised, there could be insufficient amounts of pulverized coal or no pulverized coal supplied to the power plant furnace. While Roll-Bowl pulverizers are referred to throughout this disclosure, the disclosure is not limited in this regard as other types of pulverizers known to those skilled in the art to which the disclosure pertains are equally applicable.

Moreover, if the coal output by the pulverizer is not of the required fineness, poor combustion can result causing unburned carbon or large pieces of coal adhering to heat transfer surfaces forming part of a boiler used in a power plant. To date, monitoring the performance of pulverizers has been accomplished via manual inspections. In many cases this has proven inadequate. For example, there is currently no self contained ability for the pulverizer to detect whether or not tramp iron that finds its way into the pulverizer is being properly expelled, or when pieces of tramp iron greater than a predetermined minimum size is encountered. In roll-bowl pulverizers, if tramp iron is not discharged, it repeatedly impacts the grinding rolls as well as the pulverizer body and bowl, potentially damaging these components and impairing the structural integrity of the pulverizer. Normally the presence of tramp iron is detected by an operator listening to the pulverizer. This is highly unreliable.

In most Roll-Bowl type pulverizers, three rolls spaced approximately 120 degrees apart are used to grind the coal. The substantial compressive forces needed to accomplish this grinding are supplied by preloaded springs. If these preloads are not properly set, the rolls will not all exert the same force on the coal, potentially inducing a detrimental vibration situation, as well as reduced pulverizer grinding and fineness capacity. In addition, there is at present, no way to detect whether or not the grinding rolls are worn or damaged. In addition, there currently is no way to detect critical bearing failure, or vibration that indicates that the entire pulverizer is overloaded. Essentially, a raft of operating issues such as, but not limited to those described above can arise in pulverizers and the present means for detecting these issues are outdated and archaic. Currently, there is no method of rapidly determining if there is a fire in a pulverizer. Such fires can damage the pulverizer and cause safety issues for personnel. There is also currently no reliable method for determining if a loss of coal flow has occurred that could change the stoichiometry inside the pulverizer from a fuel rich normal operating regime to a fuel lean operating regime.

SUMMARY

According to aspects illustrated herein, there is provided, a system for monitoring the operating condition of a plurality of pulverizers that include, at least one sensor interface module positioned on or proximal to each of the plurality of pulverizers. The sensor interface modules operable to receive information generated by one or more sensors mounted on the pulverizer with which the sensor interface module is associated. A single operator control station is in communication with the sensor interface modules for receiving data therefrom relevant to the signals received from the sensors. The operator control station is further operable to generate operational information indicative of at least one functional characteristic of the pulverizer and to track the operational information to determine whether degradation of the functional characteristic is occurring.

In yet another aspect, the above-described system for monitoring pulverizers includes a load cell coupled to a spring loading assembly forming part of the pulverizer, the load cell being in communication with the sensor interface module and operable to detect forces imparted to the spring loading system. In this embodiment, the operator control station receives data from the sensor interface module corresponding to the forces detected by the load cell. The operator control station is operable to analyze the received data generate a reporting that conveys information indicative of the loading on one or more journal grinding wheels forming part of the pulverizer. Roll mill pulverizers generally include at least three grinding wheels and at least three spring loading assemblies. Each of the spring loading assemblies is in communication with one of the grinding wheels and has a load cell coupled thereto. The operator control station is operable to compare the received data and determine if loading on the grinding wheels is uneven thereby indicating a detrimental operating condition within the pulverizer.

In still another aspect, it is difficult to determine the presence of a pulverizer fire. In the present invention, a CO sensor is positioned in an outlet forming part of the pulverizer and a temperature sensor is positioned at or near the outlet. The operator control station is operable to convert the data received from the sensor interface module relative to the CO sensor and the temperature sensor into outlet CO and outlet temperature levels and to track the outlet CO and temperature levels. The operator control station issues an alarm when one or both of the outlet CO and the outlet temperature levels reach predetermined levels.

In yet another aspect, the pulverizer includes a coal pipe for transporting coal out of the Pulverizer. An air flow meter monitors the flow of air through the coal pipe and a humidity meter is provided to monitor the amount of moisture in the air flowing through the coal pipe. The operator control station is operable to convert the data received from the sensor interface module relative to the air flow meter and the humidity meter and to track air flow through, and humidity in the coal pipe.

The operator control station causes an alarm to be actuated when one or both of the outlet airflow and the humidity reach predetermined levels.

In yet another aspect, a method for monitoring the operating condition of a plurality of pulverizers includes providing a sensor interface module mounted on or proximal to each of the plurality of pulverizers, the sensor interface modules having as inputs, data as detected by one or more sensors mounted on or proximal to each of the plurality of pulverizers. The data as generated by the sensors is received at the sensor interface module where it is, if needed, further conditioned and if needed, converted from analogue to digital data. An operator control station is provided and is in communication with the sensor interface module. The operator control station generates operational information indicative of at least one functional characteristic of each of the pulverizers it is monitoring and monitors and compares the operational information over time to determine the extent, if any, of degradation of the functional characteristic of the pulverizer.

DETAILED DESCRIPTION

Figure 1:
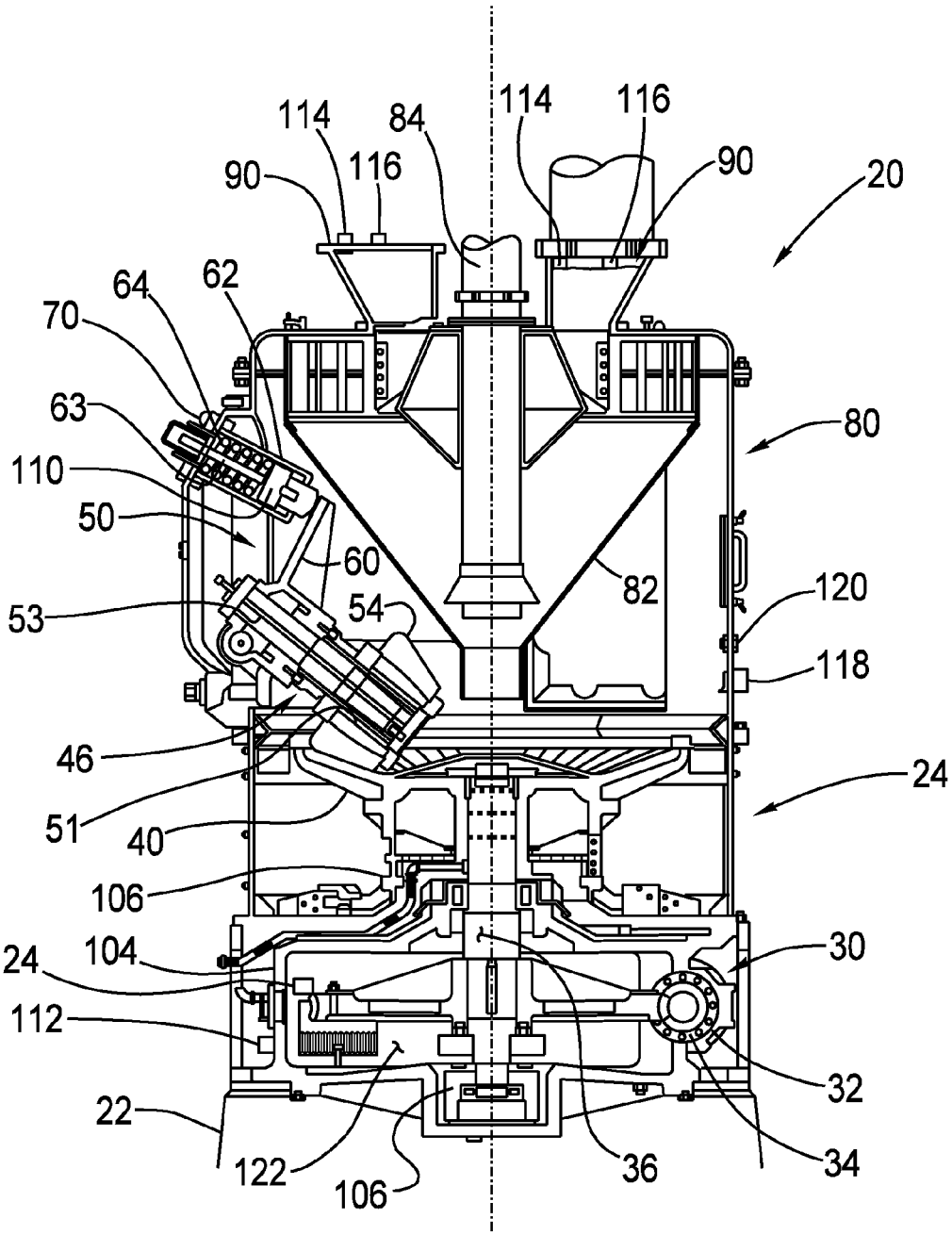
FIG. 1 is a partial cross-sectional view of an exemplary pulverizer.

As shown in FIG. 1, a pulverizer is generally designated by the reference number 20. The pulverizer 20 is exemplary of a Roll-Bowl type pulverizer and while the description herein will be made with respect to such a pulverizer, the disclosure herein is not to be limited in such regard as it is applicable to other types of pulverizers Impact-type pulverizers, Hammer-type pulverizers and Attrition-type pulverizers.

The pulverizer 20 is supported by a foundation 22 and includes a housing 24 positioned on the foundation. The housing 24 supports the pulverizer 20. In the illustrated embodiment, a drive assembly 30 is positioned in the housing 24 and includes a motor-driven worm drive 32 that rotates a worm gear 34 that drivingly and rotatably engages a shaft 36. While a motor driven worm drive 32 has been shown and described, the present invention is not limited in this regard as a motor driven gearbox could be substituted for the motor driven worm drive without departing from the broader aspects of the present invention. A coal grinding bowl 40 is coupled to the shaft 36. Three roll assemblies 46 (only one shown) are equidistantly, approximately 120° apart, positioned in close proximity to the rotating coal grinding bowl 40. Each of the roll assemblies 46 is part of a journal assembly 50 that is supported by the housing 24. The journal assembly includes a roll assembly 46 which rotatably supports a grinding roll 54. The roll assembly 46 is mounted on and rotates about a roll pivot shaft (not shown) which allows the roll assembly to deflect during operation.

A support arm 60 extends from the roll assembly 46. A threaded rod 63 extends from the support arm 60 and includes a spring base 62 attached at an end thereof. A spring 64 engages the spring base 62, which in turn engages the support arm 60. A spring cap 70 is coupled to a separator housing 80 (as described below) with the spring 64 being interposed between the spring base 62 and the spring cap. During operation, the roll assembly is deflected when the grinding forces against the roll 54, which are transferred through the support arm 60, are sufficient to overcome the preloaded spring force.

The separator housing 80 is disposed around the roll assemblies 52 and is supported by the mill housing 24. In the illustrated embodiment, a center feed inlet 84 extends into the separator housing 80. The center feed inlet 84 further extends into a separator cone 82, wherein the inlet 84 deposits the raw material into the center of the grinding bowl 40. The raw material is then uniformly distributed radially by centrifugal force to the grinding zone of the bowl where the material is then crushed by the grinding rolls 54. While the material is repeatedly crushed and ground to a finer consistency, conveyance gas, usually air, is forced into the mill housing and the finer particles are carried upwardly into the separator housing 80. Particles that are fine enough are conveyed through the outlet pipes 90 while larger aparticles are returned via the separator cone 82 for further grinding.

Figure 2:
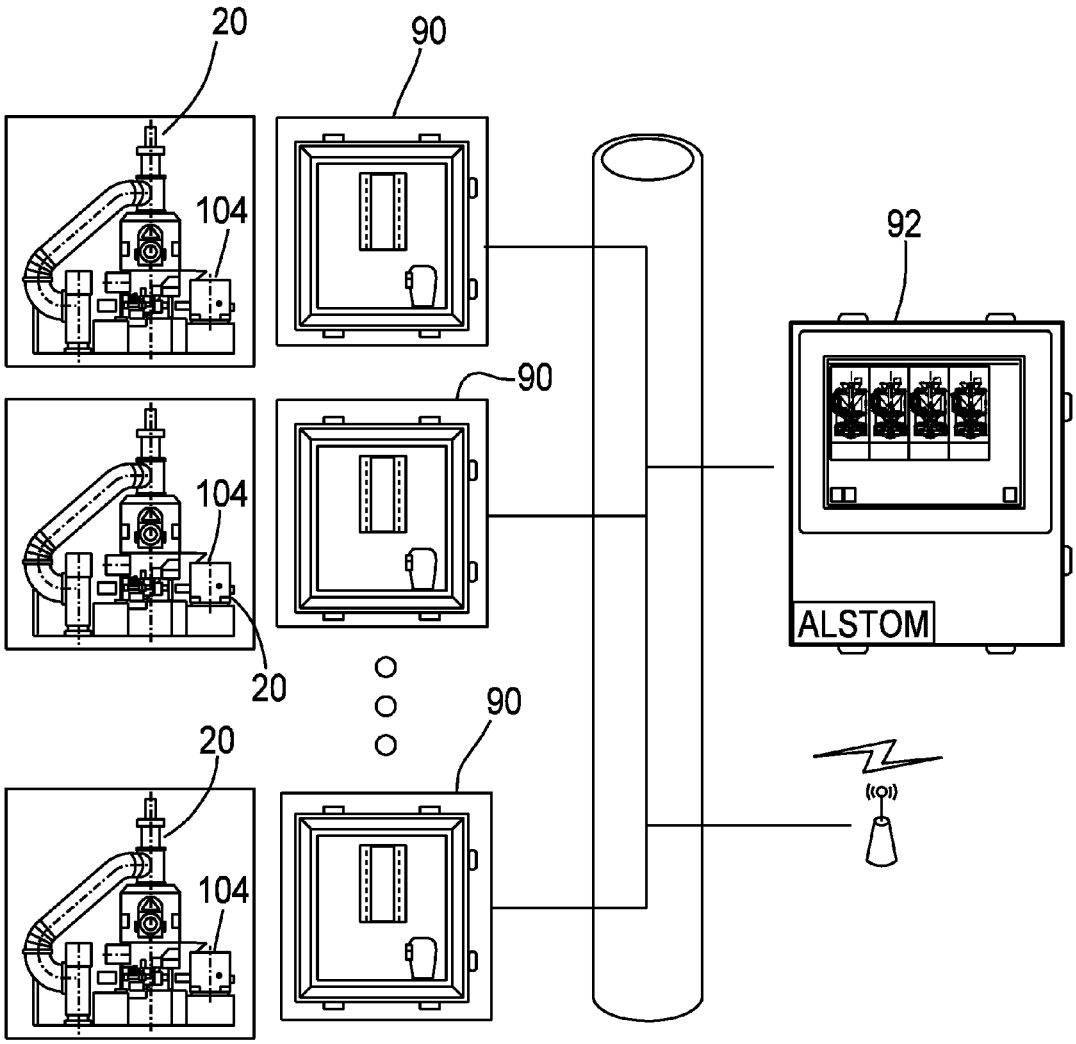
FIG. 2 schematically illustrates sensor interface modules in communication with pulverizers and an operator control station in communication with the sensor interface modules.

As shown in FIG. 2, three sensor interface modules 92 are each associated with a pulverizer 20. As will be explained in greater detail below, each sensor interface module 90 is operable to receive as an input, information generated by one or more sensors mounted on the pulverizer 20 with which the sensor interface module is associated. The sensor interface module 90 can be mounted on the pulverizer 20, or in close proximity thereto. The sensor interface module 92 associated with more than one pulverizer 20 can also be housed together. As will be explained in detail below, various different types of sensors, such as, but not limited to, load cells, accelerometers, thermocouples, flowmeters, and the like can be mounted on the pulverizer 20 and monitored by the sensor interface module 90. Each of the sensors, alone or in combination, can be employed to monitor a functional characteristic of the pulverizer 20 upon which the sensor(s) is mounted. In the illustrated embodiment, the three sensor interface modules 90 collectively communicate with a single operator control station 92. The operator control station 92 is in communication with each of the sensor interface modules 90 via TCP/IP a CAN link or the like. As will be explained in greater detail below, the operator control station 92 is operable to generate operational information indicative of at least one functional characteristic of the pulverizer 20 and to track said operational information to determine whether degradation of the functional characteristic is occurring. As used herein, the term "functional characteristic" should be broadly construed to mean any operating condition of a pulverizer, such as, but not limited to, temperature, vibration, loads on components, flow of gases and/or solids, humidity levels, and the like. While a single sensor interface module 90 has been shown as being associated with a pulverizer 20, the present invention is not limited in this regard as more than one sensor interface module can be associated with each pulverizer without departing from the broader aspects of the present invention. Similarly, while a single operator control station has been shown and described, the present invention is not limited in this regard as more than one operator control station can be employed to monitor multiple pulverizers without departing from the broader aspect of the present invention.

Each sensor interface module 90 can be configured to provide signal conditioning and/or analog to digital conversion of the information generated by and received from the sensors associated with the pulverizer 20. In addition, the sensor interface modules 90 can also perform basic signal processing, such as, for example, determination of mean values, maximum and minimum values, and root mean square (RMS) values of the information received from the sensors.

Figure 3:
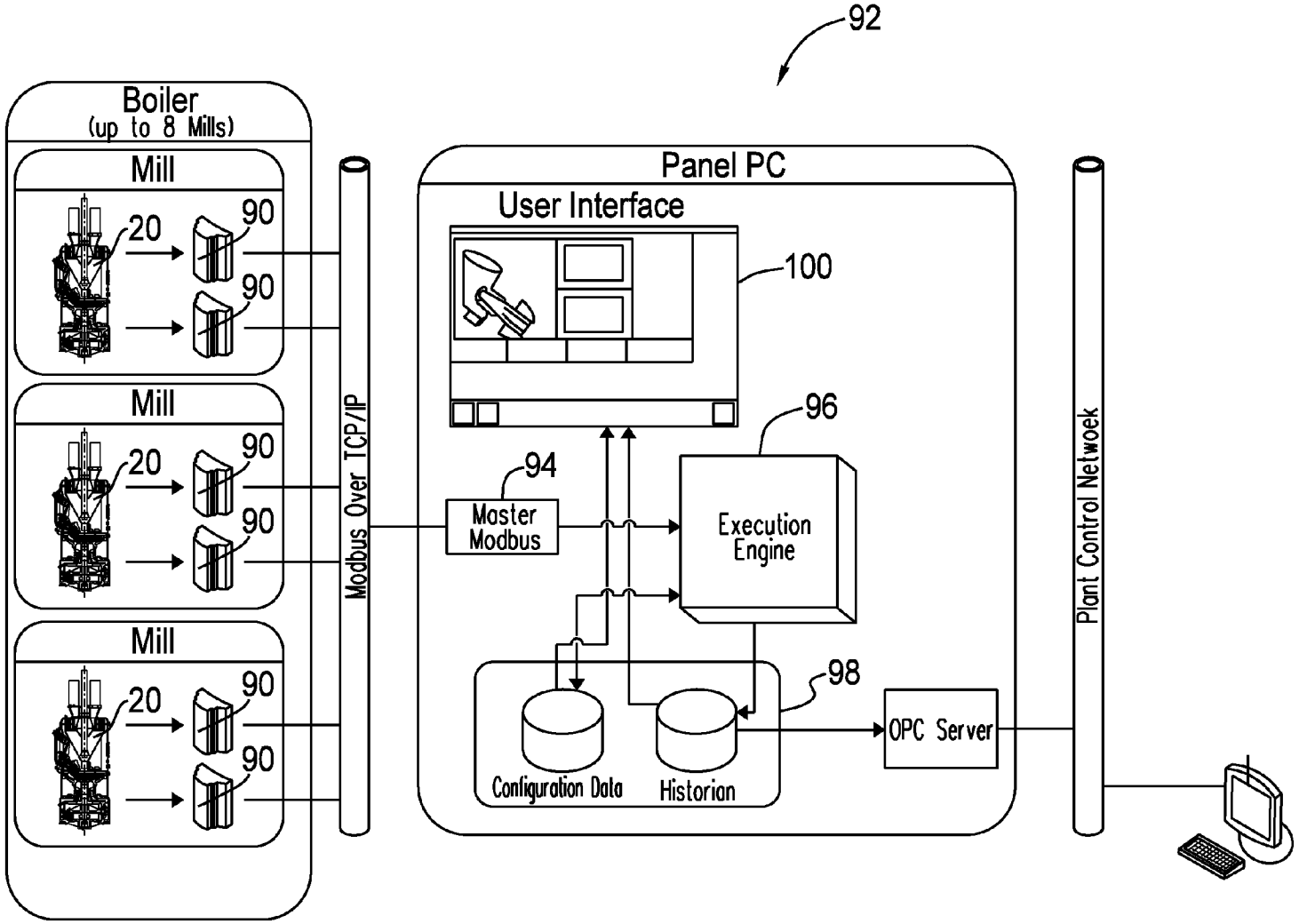
FIG. 3 schematically illustrates sensor interface modules in communication with pulverizers and an operator control station in communication with the sensor interface modules, the operator control station being shown in greater detail.

Turning to FIG. 3, in the illustrated embodiment, each pulverizer 20 has two sensor interface modules 90 associated with it. All six of the sensor interface modules 90 shown in FIG. 3 are in communication with the operator control station 92. In the illustrated embodiment, the operator control station 92 includes a MODBUS 94 that is in communication with each of the sensor interface modules 90. The MODBUS 94 receives and collects data from each of the sensor interface modules 90 indicative of the information detected by the sensors. The MODBUS 94 is also in communication with an execution engine 96. The execution engine 96 receives data from the MODBUS 94 and can perform calculations and data manipulations such as, but not limited to, statistical calculations. In addition the execution engine 96 is operable to generate alarms when the data received indicates a problem with a pulverizer 20 being monitored by the operator control station 92. The execution engine 96 is in communication with a server 98. Data received by and/or generated by the execution engine 96 is stored in the server 98 for historical purposes. In addition, configuration data is transferred to the server 98 from the execution engine 96 and vice versa.

Figure 4:
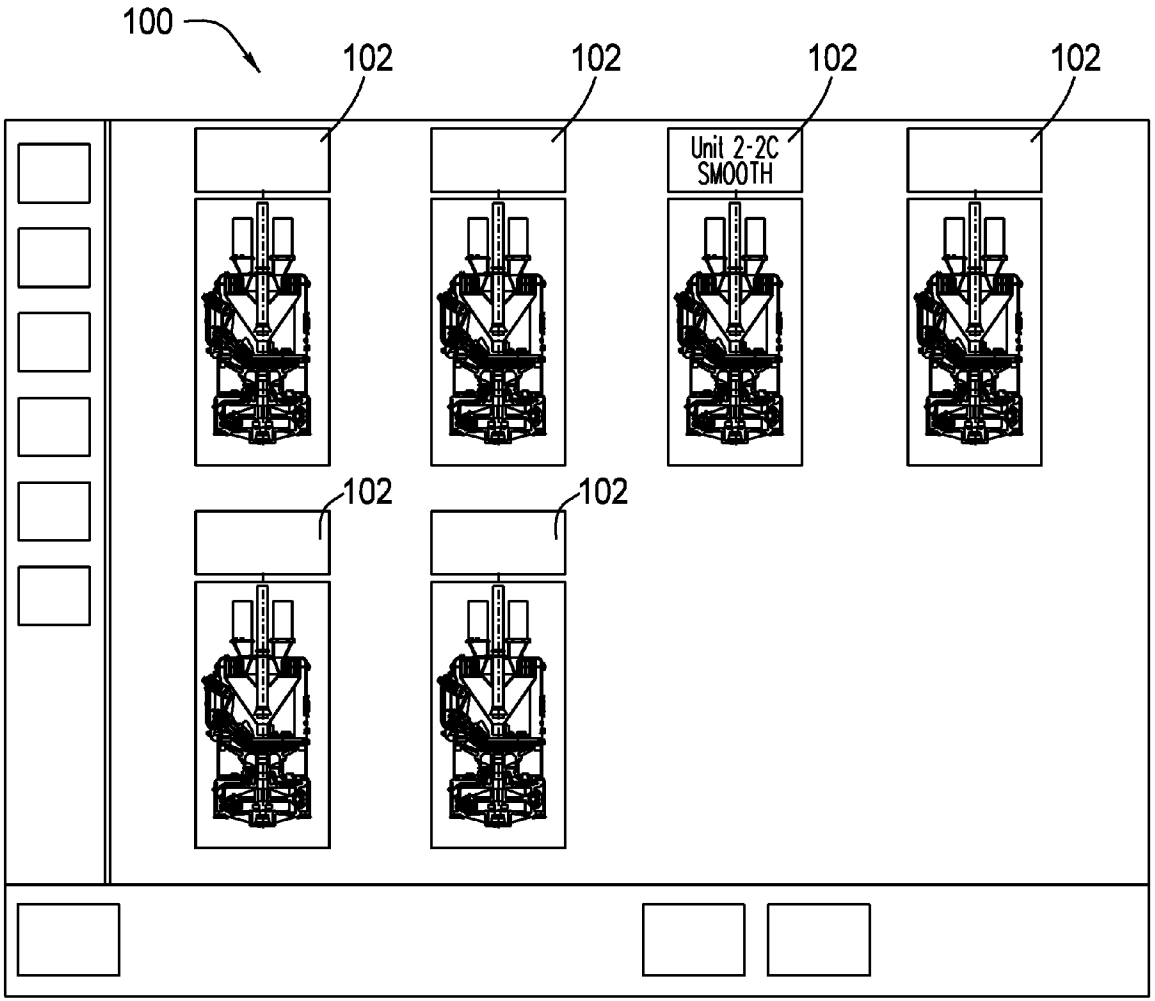
FIG. 4 is a screen shot of a display on the operator control station showing six pulverizers being monitored.

Still referring to FIG. 3, the operator control station 92 includes a user interface 100, which in the illustrated embodiment is a touch-screen display. The touch screen display 100 can, inter alia, display alarms, runtime and historical data, runtime and historical events, as well as diagnostics. As shown in FIG. 4, during operation of the operator control station 92, the touch-screen display 100 can show icons 102 illustrative of the pulverizers being monitored. The icons 102 can provide an indication of the operational status of each of the pulverizers. For example, the icons 102 can indicate whether or not the pulverizers are operating smoothly or are disconnected. In addition, the icons 102 can change colors to indicate the operational status of the pulverizer. For example, a green color can indicate normal operation, orange can indicate a warning, yellow can indicate that questionable data is being received and grey can indicate that the pulverizer is offline. However, the present invention is not limited in this regard as any number of colors can be used to indicate any number of pulverizer operating conditions without departing from the broader aspects of the present invention. Moreover, other manners of indicating pulverizer operating conditions, such as, for example, a blinking icon can also be utilized.

The touch-screen display 100 can also show such things as graphical depictions of analog signals received from the sensor interface modules 90. Current and historic data and information can also be displayed. The operator control station 92 can also employ different levels of security protocols. For example, for viewing pulverizer status on the touch screen display 100, no security protocol may be required. To view or request certain data and/or information to be displayed, such as a pulverizer operator may need, a security protocol such as, but not limited to, a password or card swipe, a fingerprint scanner or the like may be required. To make changes to system configurations, set points or other parameters, a higher level of security protocol may be required. While a touch screen display has been shown and described, the present invention is not limited in this regard as any suitable display known to those skilled in the art to which the present invention pertains can be employed.

As will be explained below, the combination of the above-described sensors, sensor interface modules 90, and the operator control station 92 can be used to monitor and predict a variety of functional characteristics of pulverizers. For example, and referring to FIGS. 1 and 2, monitoring the loading on the grinding rolls 54 can be accomplished by mounting a load cell 110 on the springs 64 used to impart a load on the grinding roll with which the spring is associated. In addition, accelerometers 112 can be placed on a gearbox 104. By monitoring the load data received from the load cell 110 and the vibration data received from the accelerometers 112 on the gearbox 104, it is possible of the operator control station 92 to determine whether the loading on the grinding rolls 54 (FIG. 1) is unequal. The operator control station 92 can issue an alert indicating the loading inequality on the grinding rolls has exceeded a predetermined value. Failure to ascertain that the loading on the grinding rolls is unequal, can result in unequal wear on the pulverizer's gearbox 104, as well as on the pulverizer motor (not shown). The main vertical shaft 36 on the pulverizer gearbox 104 could become damaged. The vibratory loads induced by operation of a pulverizer with unequally loaded grinding rolls can cause premature wear as well as reduce the life span of components. Pulverizer capacity can be reduced and coal spillage can occur.

The above-described alerts can take on many forms, for example, an audible alert can be sounded, a visual alert can be employed. In addition, text messages can be sent, phones can be dialed and emails may be sent. In addition, any combination of the above-described alerts can be employed.

Pulverizers, utilize many bearings in order to facilitate the rotation and/or movement of components. In order to monitor the condition of these bearings, accelerometers (not shown) are placed on the housings 106 into which the bearings are mounted. These accelerometers are monitored by the sensor interface modules 90 which in turn communicate the data received from the accelerometer to the operator control station 92. The operator control station 92 is operable to transform this data into vibration levels and to compare these vibration levels to historic vibration data stored in the operator control station or to predetermined set points. This allows for normal bearing degradation to be monitored, bearing failure to be predicted. Moreover the operator control station can issue an alarm when detrimental bearing operation is determined. The operator control station 92 is operable to track and graphically display bearing vibration levels over time. Still referring to FIG. 1 the journal assemblies 50, only one shown, each include an oil reservoir 51 for lubricating the roll assembly 46. A thermocouple 53 is positioned in the roll assembly 46 to monitor the temperature of bearings forming part of the roll assembly. The thermocouple 53 is monitored by the sensor interface module 90 which in turn communicates the data received from the thermocouple to the operator control station 92. The operator control station 92 is operable to transform the data received from the thermocouple 53 into temperature information and to compare this temperature information to historic temperature information stored in the operator control station.

Pulverizers are typically driven by a motor and gearbox 104. Component failure and the onset of component failure generally results in an increase in vibration within the gearbox. The above-described monitoring system can include accelerometers 112 mounted on the gearbox in order to measure gearbox vibration. The acceleration data detected by the accelerometers mounted on the gearbox is received by the sensor interface module 90 associated with the pulverizer 20 being monitored. The sensor interface module 90 communicates the data received from the accelerometer to the operator control station 92. The operator control station 92 is operable to transform this data into vibration levels and to compare these vibration levels to historic vibration data stored in the operator control station or to predetermined set points. Alarms can be issued by the operator control station when a vibratory condition detrimental to the gearbox is detected. Moreover, the operator control station 92 is operable to track and graphically display the gearbox vibration levels over time.

Pulverizers typically employ one or more outlet pipes 90 that can be prone to becoming plugged by the pulverized coal. In order to minimize the potential for plugging, the above-described system can employ air flow sensors 114 and humidity sensors 116 within the outlet pipes 90. By monitoring the air flow and humidity, action can be taken prior to the outlet pipes 90 becoming clogged. Accordingly, the sensor interface module 90 associated with the pulverizer, receives data from the air flow and humidity sensors, 114 and 116 respectively. This data is transferred to the operator control station 92 where it can be compared with set points and historic data. An alarm can be issued by the operator control station 92 if the airflow and/or humidity data reach predetermined levels.

There are times during the operation of a pulzerizer where the pulverized coal ignites causing a fire within the pulverizer. Historically, pulverizer fires have been detected during visual inspections and are often detected well after the fire has started. These fires can damage the pulverizer and can pose serious safety risks to personnel. The above described system can employ a carbon monoxide sensor 118 and/or an outlet temperature sensor 120 to monitor CO emissions from the pulverizer as well as to detect increases in temperature within the pulverizer. Accordingly, the sensor interface module 90 associated with the pulverizer, receives data from the CO sensor and/or the temperature sensor and communicates information relevant thereto to the operator control station 92 where it can be compared with set points and historic data. An alarm can be issued by the operator control station if the CO and/or temperatures levels exceed predetermined levels. The sensor locations shown in the illustrated embodiment are for illustrative purposes only as the exact sensor locations can vary depending on the type of pulverizer, optimal sensor locations, and/or the installation configuration of the pulverizers.

As described above, pulverizers generally employ a variety of bearings, as well as a gearbox 104. These components are usually lubricated with oil. As such, an oil reservoir 122 is typically provided and the oil level therein maintained. Failure to maintain the oil level within the oil reservoir 122 can result in improper gearbox 104 and/or bearing lubrication, thereby generating the potential for catastrophic failure of these components and thereby, the pulverizer. The above-described system can incorporate an oil level sensor 124 into the oil reservoir 122, such as, but not limited to a float switch that would be actuated when the oil level drops to a predetermined level. Accordingly, the sensor interface module 90 associated with the pulverizer, receives an input that the float switch has been actuated and communicates this information to the operator control station 92. An alarm can be issued by the operator control station to provide an alert that the oil level in the reservoir has dropped below a predetermined level.

In addition, the disclosure herein is to be broadly construed to include the fact that any number of different sensors and sensor types can be positioned on a pulverizer and be in communication with the above-described sensor interface modules. The type and location of the sensors is dependent upon what functional characteristic of the pulverizer is being monitored.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for monitoring the operating condition of a pulverizer comprising:

at least one sensor interface module positioned on or proximal to said pulverizer, said sensor interface module being operable to receive information generated by one or more sensors associated with said pulverizer;

an operator control station in communication with said at least one sensor interface module, said operator control station being operable to receive data from said sensor interface module;

wherein one of said sensors is a load cell; and a spring loading assembly, said load cell being coupled to the spring loading assembly, at least one grinding wheel, said grinding wheel being coupled to said spring loading assembly, wherein said load cell is operable to detect actual forces imparted to said spring loading assembly.

2. The system of claim 1, wherein said operator control station is operable to generate operational information indicative of at least one functional characteristic of said pulverizer and to track said operational information to determine whether degradation of said functional characteristic is occurring.

3. The system of claim 2, wherein said operator control station being further operable to issue an alarm when said data received therefrom reaches a predetermined level.

4. The system of claim 1, wherein said operator control station being operable to compare said received data and determine if loading on said grinding wheels is uneven thereby indicating a detrimental operating condition of said pulverizer.

5. The system of claim 4, wherein said sensor interface module being further operable to receive information generated by a second sensor associated with said pulverizer, wherein said second sensor is an accelerometer.

6. The system of claim 5, wherein said pulverizer further comprises a gearbox;

said accelerometer being in communication with said gearbox; and said operator control station employs said received data corresponding to forces detected by said load cell and received data corresponding to said accelerometer to generate information indicative of at least one of unequal wear and degradation of said gearbox.

7. A system for monitoring the operating condition of a pulverizer comprising:

at least one sensor interface module positioned on or proximal to said pulverizer, said sensor interface module being operable to receive information generated by one or more sensors mounted on said pulverizer with which said sensor interface module is associated;

an operator control station in communication with said at least one sensor interface module associated with said pulverizer, said operator control station being operable to receive data from said sensor interface module;

said operator control station is operable to generate operational information indicative of at least one functional characteristic of said pulverizer and to track said operational information to determine whether degradation of said functional characteristic is occurring;

said operator control station being further operable to issue an alarm when said data received therefrom reaches a predetermined level;

said pulverizer comprises a spring loading assembly, a grinding wheel, and a gearbox;

wherein one of said sensors is a load cell, said load cell being coupled to the spring loading assembly, said spring load assembly coupled to said grinding wheel, wherein said load cell is operable to detect actual forces imparted to said spring loading assembly;

wherein a second sensor includes at least one accelerometer, said gearbox being in communication with said accelerometer; and said operator control station employs said received data corresponding to forces detected by said load cell and received data corresponding to said accelerometer to generate information indicative of at least one of unequal wear and degradation of said gearbox.

* * * * *